United States Patent [19]

Schwarzbeck

[11] Patent Number: 4,572,069

[45] Date of Patent: Feb. 25, 1986

[54] DEVICE FOR CHANGING A NUMBERING AND IMPRINTING DEVICE IN A PRINTING PRESS

[75] Inventor: Erich Schwarzbeck, Heidelberg, Fed. Rep. of Germany

[73] Assignee: Hiedelberger Druckmaschinen AG, Heidelberg, Fed. Rep. of Germany

[21] Appl. No.: 707,503

[22] Filed: Mar. 4, 1985

[30] Foreign Application Priority Data

Mar. 2, 1984 [DE] Fed. Rep. of Germany ..... 3407681

[51] Int. Cl.[4] ..... B41L 45/00

[52] U.S. Cl. ..... 101/76; 101/216

[58] Field of Search ..... 101/76, 77, 74, 75, 101/72, 216, 219, 141, 247; 400/82, 609, 605

[56] References Cited

U.S. PATENT DOCUMENTS

| | | | |
|---|---|---|---|
| 1,443,164 | 1/1923 | Bracken | 101/5 |
| 3,728,960 | 4/1973 | Heath | 101/76 |
| 4,434,715 | 3/1984 | McHenry | 101/76 |

*Primary Examiner*—Clifford D. Crowder

*Attorney, Agent, or Firm*—Herbert L. Lerner; Laurence A. Greenberg

[57] ABSTRACT

A device for exchanging a numbering and imprinting device having a numbering shaft for carrying numbering units thereon and provided with an associated inking unit in a printing press, for another numbering and imprinting device mounted on another numbering shaft, the exchanging device includes a swivelling device swivellable about a horizontal pivot axis extending parallel to the axis of the numbering shaft, the swivelling device being formed of gripper elements, arranged on a cross member and carrying respective left-hand and right-hand journal pins of the numbering shaft, the horizontal pivot axis being formed by the axis of the cross-member, and the cross-member being mounted longitudinally displaceably on a carriage guide secured to a machine frame located at an end of the printing press, the carriage guide extending parallel to the axis of the numbering shaft.

18 Claims, 7 Drawing Figures

DEVICE FOR CHANGING A NUMBERING AND IMPRINTING DEVICE IN A PRINTING PRESS

The invention relates to a device for exchanging a numbering and imprinting device having a numbering shaft for carrying numbering units thereon and provided with an associated inking unit in a printing press, for another numbering and imprinting device mounted on another numbering shaft, the exchanging device including a swivelling device swivellable about a horizontal pivot axis extending parallel to the axis of the numbering shaft.

It has become known, for example, to equip sheet-fed offset printing presses in special versions also with a numbering station, thereby enabling the press to be used not only for printing but also for combined printing and numbering jobs. Such a numbering station is formed of a numbering shaft couplable to the drive of the press, with seating rings on which one or more numbering units can be mounted depending upon the printing job. The numerals or digits of the numbering units are inked by a numbering inking unit associated with the numbering units, while the numbers are changed by switching cams.

The numbering shaft is conventionally equipped with the individual numbering units off i.e. outside of, the press. The entire numbering station must therefore be removed from the press or, alternatively, the numbering shaft is re-equipped and reset anew, respectively, which generally entails a shutdown of the press for an extended period of time.

For better handling, numbering shafts and numbering inking units are therefore mostly removable from the press separately (German Pat. No. 22 21 343).

In various numbering jobs, such as the printing of bank checks, for example, for which special check-printing machines are customarily used, personal data such as names, addresses and the like can be printed on the check forms by the press's printing unit, while the post-connected numbering unit applies the variable check numbers. Because check imprints are often required only in very limited print runs, the numbering data have to be changed constantly within relatively short periods of time. In order to avoid extended machine idle or shutdown periods arising therefrom, check printers generally operate with two numbering shafts, one of which is in the press during the printing of the edition, while the second shaft is being preset off the machine for the next job, in the interim.

Thus, special check-printing presses have become known heretofore in which the numbering station is already formed of two numbering shafts respectively located selectively in operating position in the press and in presetting position in front of the press.

In one application of such presses, the two shafts, respectively, are mounted on a common bearing arm with only one journal pin each, the mounting of the bearing arm fixedly to the machine frame taking place on a horizontal bearing axle or shaft in the middle of the bearing arm, the bearing axle or shaft being rotatable on at least one side panel of the machine and being to a given extent withdrawable therefrom. To change the numbering shaft, the two shafts are drawn laterally out of the machine frame together and, rotated through 180°, are reinstalled (U.S. Pat. No. 3,728,960). A comparable method or procedure is also to be found in machine tool manufacture for changing tools with their holders.

A further heretofore known type of application is the swinging-out of one double-shaft mounting or bearing from the press, about a horizontal axis, the double-shaft mounting or bearing carrying both numbering units, the double-shaft mounting or bearing for the two numbering shafts being also turned through 180° and being swung back into the machine again. For this purpose, a swivelling device which is swivellable about a rotary axle or shaft running parallel to the numbering-shaft axis is employed. (A. B. Dick).

Both of the foregoing heretofore known different constructions suffer from the serious disadvantage that the presetting position of the second numbering shaft is extremely unfavorable because, from this end position of the press, the press operator also has to work, for example, on the main printing unit or on other units situated in this end region of the press and, in addition, the delivery of the printed sheets onto the delivery stack has to be kept under observation.

Starting from these considerations, it is accordingly an object of the invention to provide a device for exchanging numbering and imprinting devices in which the second numbering shaft, intended for presetting, is situated in a presetting place suitable for that purpose yet located outside or beyond the operating and observational region of the press units.

With the foregoing and other objects in view, there is thus provided, in accordance with the invention, a device for exchanging a numbering and imprinting device having a numbering shaft for carrying numbering units thereon and provided with an associated inking unit in a printing press, for another numbering and imprinting device mounted on another numbering shaft, the exchanging device comprising a swivelling device swivellable about a horizontal pivot axis extending parallel to the axis of the numbering shaft, the swivelling device being formed of gripper elements, arranged on a cross member and carrying respective left-hand and right-hand journal pins of the numbering shaft, the horizontal pivot axis being formed by the axis of the cross-member, and the cross-member being mounted longitudinally displaceably on a carriage guide secured to a machine frame located at an end of the printing press, the carriage guide extending parallel to the axis of the numbering shaft.

In accordance with another aspect of the invention, there is provided, in accordance with the invention, a device for exchanging a numbering and imprinting device having a numbering shaft for carrying numbering units thereon and provided with an associated inking unit in a printing press, for another numbering and imprinting device mounted on another numbering shaft, the exchanging device comprising swivelling means swivellable about a horizontal pivot axis, extending parallel to the axis of the numbering shaft, the swivelling means being formed of gripper elements arranged on a cross member and carrying respective left-hand and right-hand journal pins of the numbering shaft, the horizontal pivot axis being formed by the axis of the cross member, and the cross member being mounted longitudinally displaceably on a carriage guide secured to a machine frame located at an end of the printing press, the carriage guide extending parallel to the axis of the numbering shaft, the swivelling means comprising respective swivelling devices associated with each of the numbering and imprinting devices, the carriage guide having a length sufficient for accommodating three of the swivelling devices simultaneously adjacent one another.

In accordance with a further feature of the invention there is provided, in accordance with the invention, a device which includes swivelling mechanism operatively connected with the inking unit associated with the first-mentioned numbering and imprinting device, the swivelling mechanism comprising articulatingly interconnected swivel arms respectively mounted rotatably in an upper region of side panels of the printing press, the inking unit being transportable by the swivel arms selectively into two depositing positions respectively.

In accordance with an added feature of the invention, the swivelling device is carried by the carriage guide, and the machine frame located at the end of the printing press to which the carriage guide is secured is located adjacent a sheet delivery of the printing press.

In accordance with a further feature of the invention, the cross-member is of tubular construction and the carriage guide is correspondingly shaft-like for carrying the cross-member and is mounted at the ends thereof on bearing supports of a base plate secured to the machine frame.

In accordance with still another feature of the invention, there is provided a device which includes stops located on the swivelling device, the stops being abuttable against the base plate and the machine frame, respectively, for limiting the swivelling range of the swivelling device.

In accordance with still an added feature of the invention, there is provided a device which includes half-shells connected, respectively, freely rotatably and fixedly attached to the drive of the printing press, the half-shells serving as bearings for the journal pins of the numbering shaft in side panels of the printing press, the half-shells cooperatively connected with clamping jaws as well as with clamping screws engaging in the half-shells for holding the journal pins of the numbering shaft.

In accordance with again another feature of the invention, the gripper elements of the swivelling device are formed as L-shaped angular lever arms having handles thereon, each of the lever arm being formed in a forward region thereof with a respective opening defined by a fork-shaped structure for receiving therein the journal pins at both ends of the numbering shaft, the lever arms being secured through the intermediary of a strut as well as through the intermediary of another arm to the cross member.

In accordance with again a further feature of the invention, each of the gripper elements of the swivelling device is formed of two legs articulatingly connected to one another, the legs being rotatably connected by a shaft at a common pivot point, one of the legs being formed with an opening defined by a fork-shaped structure for receiving therein the journal pins, respectively, at both ends of the numbering shaft and having a further bearing point for another shaft, and the other of the legs having a connecting link guide operatively associated with the other shaft.

In accordance with still an added feature of the invention, there is provided a device which includes indexing sleeves disposed on the other shaft, the indexing sleeves being displaceable in longitudinal direction along the other shaft, and further including stops and compression springs on the other shaft for bracing the indexing sleeves, one of the legs being formed with index bores wherein the indexing sleeves are latchable in an end position of the swivelling movement of both of the legs.

In accordance with still an additional feature of the invention, the indexing sleeves are formed as handles.

In accordance with again an added feature of the invention, there is provided a device which includes a spring element engaging the pivot points of the legs of the swivelling device, and a connecting link guide having suitable dimensions for varying the relative swivel angle between both of the legs over a wide range.

In accordance with again a further feature of the invention, the numbering and imprinting device and the inking unit operatively associated therewith are movable by the swivelling device.

In accordance with yet another feature of the invention, the forward region of the gripper elements with the fork-shaped structure defining the opening has a two-part construction, a gripper arm is rotatably mounted in a pivot point of each of the gripper elements and braced against a compression spring, and a roller lever is connected to the pivot point and fixed against rotation with respect to the gripper arm, the roller lever carrying a cam roller following an opening cam disposed on the machine frame in vicinity of a bearing for the numbering shaft.

In accordance with yet a further feature of the invention, the fork-shaped structure defining the opening in the forward region of the gripper elements is of one-part construction.

In accordance with a concomitant feature of the invention, the opening defined by the fork-shaped structure having a two-part construction is of such dimension that, in both "Printing ON" and "Printing OFF" positions of the rotary numbering shaft, the numbering shaft is out of contact with the fork-shaped structure.

Other features which are considered as characteristic for the invention are set forth in the appended claims.

Although the invention is illustrated and described herein as embodied in a device for changing a numbering and imprinting device in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
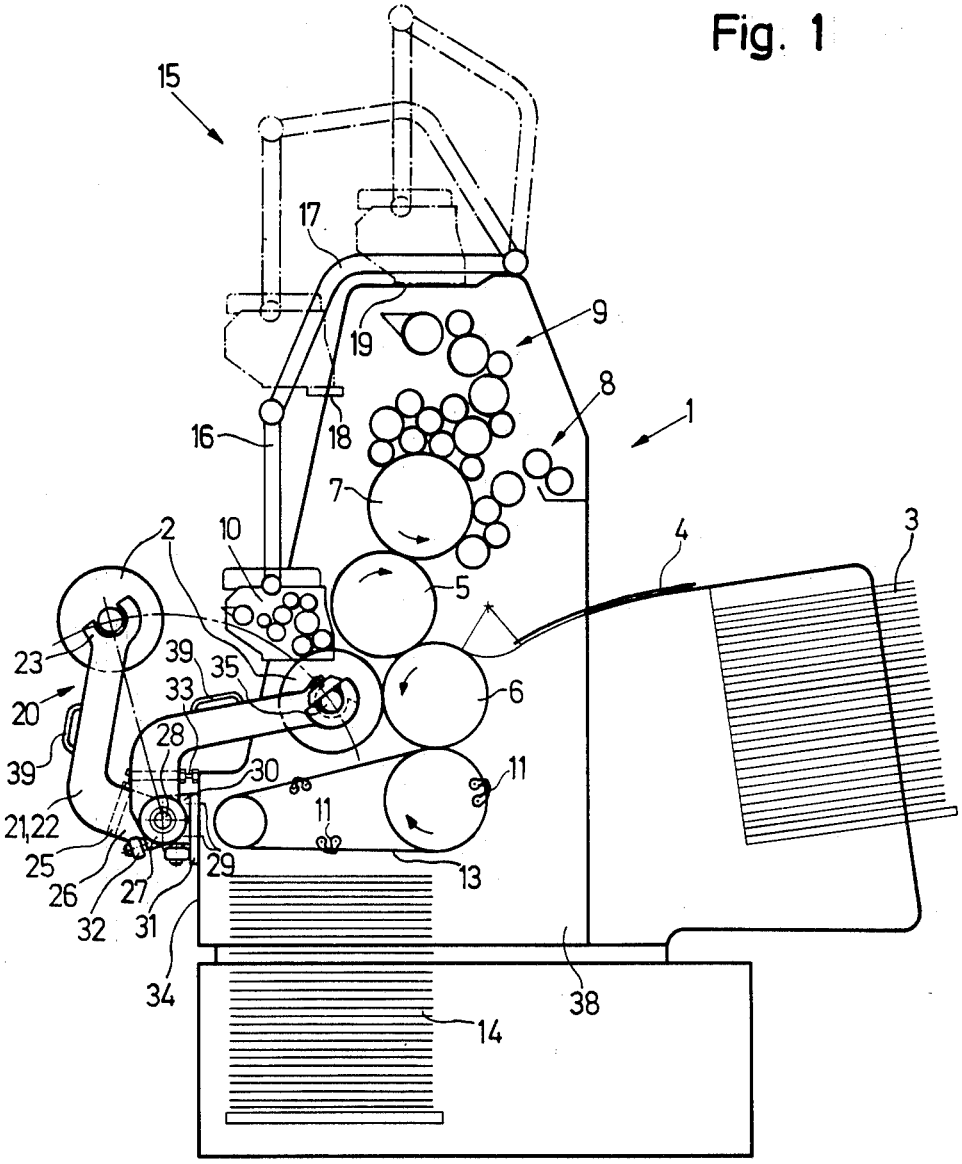
FIG. 1 is a diagrammatic side elevational view of a single-color sheet-fed rotary printing press with a device for changing numbering shafts in accordance with the invention.

Referring now to the drawing and first, particularly, to FIG. 1 thereof, there is shown therein diagrammatically a single-color sheet-fed rotary printing press 1 having a built-in numbering and imprinting device 2. A sheet 4 separated from a stack 3 is led, via a non-illustrated feeder, into a gap or nip between a rubber or blanket cylinder 5 and an impression cylinder 6, at which an overprinting of the printing image occurs. The printing image is transferred to the blanket cylinder 5 from a plate cylinder 7, a dampening unit 8 and an inking unit 9 being associated with the plate cylinder 7.

After the printing image has been transferred to the paper sheet 4, the corresponding overprint takes place in the post-connected numbering and imprinting device 2. A separate inking unit 10 is associated with the numbering and imprinting device 2.

The printed sheet 4 is passed on by a non-illustrated gripper arrangement of the impression cylinder 6 and fed to a gripper device 11 which takes the sheet 4 over, then the sheet 4 is passed on to a delivery stack 14 by way of a delivery chain 13 equipped with the gripper device 11.

The inking unit 10, which is associated with the numbering and imprinting device 2, is couplable with a swivelling mechanism 15 formed of two articulatingly interconnected and pairwise arranged swivel arms 16 and 17 (note FIG. 2), the inking unit 10 being transportable with the aid of the swivelling mechanism 15, to two depositing positions 18 and 19 thereof shown in phantom, in order, for example, to allow the press operator unhindered access to the printing-unit cylinders 5 and 6 of the press.

The swivelling device 20 for changing the numbering and imprinting device 2 is formed of two L-shaped angular lever arms 21 and 22 provided with lifting handles 39, each of the lever arms 21 and 22 being formed in the forward region thereof with a respective fork-shaped opening 23 for receiving therein respective journal pins 24 located at each end of a numbering shaft 35 of the numbering and imprinting device 2. The lever arms 21 and 22 are secured to a tubular cross-member or traverse 27 through the intermediary of a strut 25 and a further arm 26. The tubular cross-member or traverse 27 is guided on a suitable shaft-like carriage guide 28 also running parallel to the numbering-shaft axis 70, the carriage guide 28 being mounted in bearing supports 30 at the ends of a base plate 31.

The base plate 31 is secured in an otherwise non-illustrated manner to a machine frame 34 at the delivery side of the press by suitable fastening means 29. Stops 32 and 33, which are arranged on the tubular cross-member 27 and on the lever arm 22, respectively, and which abut the base plate 31 and the delivery-side machine frame 34 of the printing presses, respectively, limit the swivelling range of the swivelling device 20.

Figure 2:
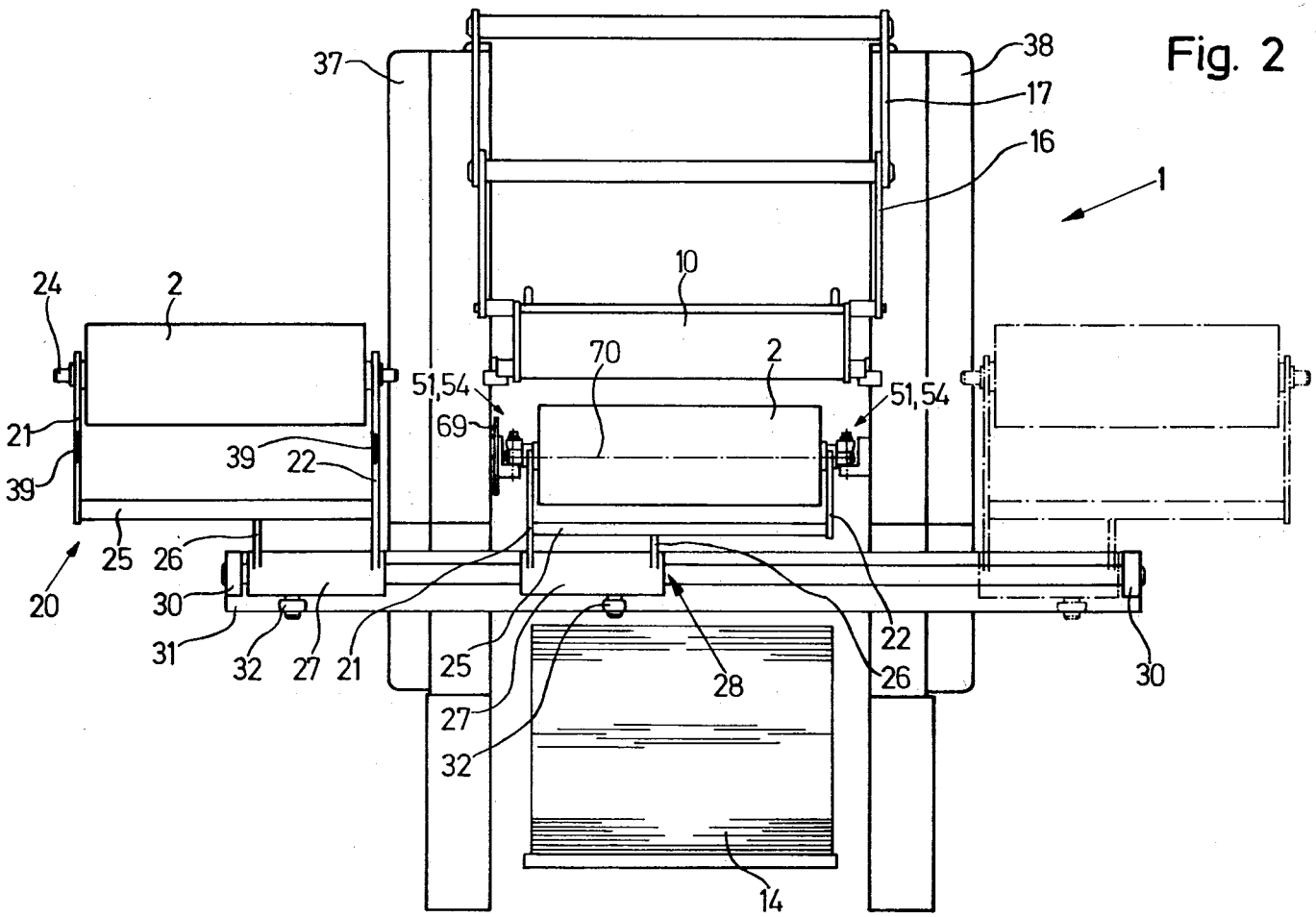
FIG. 2 is an elevational view of FIG. 1 as seen from the left-hand side thereof.

As shown especially in FIG. 2, the carriage guide 20 and the said base-plate 31 secured to the front of machine-frame 34, respectively, are of a length calculated to provide place for three swivelling devices 20, each with numbering and imprinting devices 2, respectively. In effect, however, only two such swivelling devices 20 are arranged on the carriage guide 28, it being possible, for example, for the swivelling devices to have a mirror-image type of construction.

The method or procedure for equipping or changing the numbering and imprinting devices 2 is as follows:

The numbering and imprinting device 2 situated in vicinity of the left-hand side panel 37 outside the printing press 1 and mounted on the swivelling device 20 is ready to be prepared for the following printing job. When the job of the numbering and imprinting device 2 which is then present in the printing press 1 is completed, the numbering and imprinting device 2 is swung out of the working region thereof by the swivelling device 20 and moved to the right-hand side into the presetting position thereof shown in phantom in FIG. 2 and associated with the side panel 38. The previously made-ready numbering and imprinting device 2 can then, with the aid of the swivelling device 20 guided on the carriage guide 28, be directly installed so that the new printing job can be performed. The numbering and imprinting device 2 then situated in vicinity of the right-hand side panel 38 can then be prepared for the next printing job without delay.

Prior to carrying out the aforementioned operating steps, the associated inking unit 10 must always be brought into one of the depositing positions 18 and 19 by the press operator by means of the swivelling mechanism 15.

Figure 3:
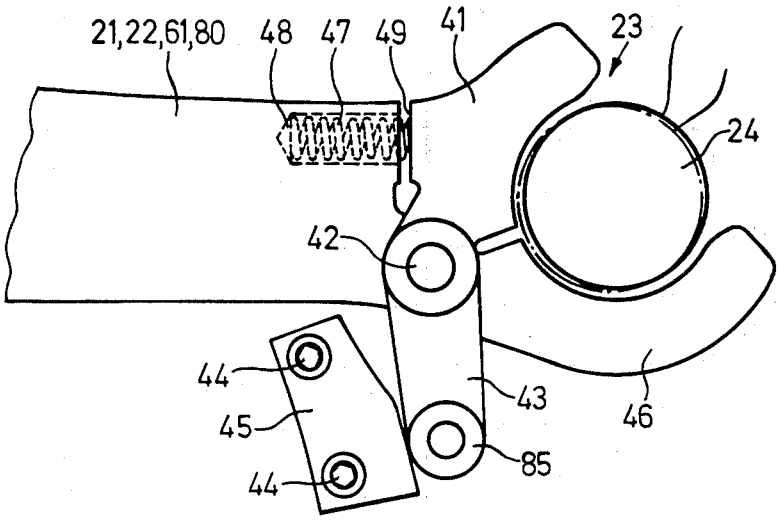
FIG. 3 is an enlarged fragmentary side elevational view of the forward region of a swivel arm forming part of the changing device of the invention.

The swivelling device 20 and the lever arms 21 and 22 thereof, respectively, remain in retracted or swung-in position while the press is running. The forklike openings 23 thereof are defined by a single part or, according to the embodiment shown in FIG. 3, by two parts of the swivelling device which, however, are not in contact with the journal pins 24 of the numbering shaft 35.

To this end, the inside radius of the fork-shaped openings 23 is so designed that no contact takes place even in the various "Printing ON" and "Printing OFF" eccentric-positions of the correspondingly mounted numbering shaft 35.

The fork-shaped openings 23 of the pairwise arranged lever arms 21 and 22 can also be constructed, as aforementioned, so that they enclose the journal pins 24 of the numbering shaft 35 in the presetting position during both the swivelling and the guiding operations in the carriage guide 28 like a pair of pliers (see FIG. 3), so that the numbering shaft 35 and hence the entire numbering and imprinting device 2 cannot rotate by itself (e.g. due to a momentary imbalance while the equipping of the device 2 is in progress).

Shortly before reaching the end position in the printing press 1, a gripper arm 41, rotatably mounted at a pivot point 42 of each lever arm 21 and 22, opens due to the running of a cam roller 85 of a roller arm 43 which is connected to the gripper arm 41, onto an opening cam 45 secured to the machine frame 34 by means of fastening bolts 44.

The pair of pliers formed by the gripper arm 41 and the forward end 46, which completes the pliers or tongs shape, of each lever arm 21 and 22 thereby, in the final working position, again surrounds the journal pins 24 of the numbering shaft 35 at such a distance or spacing that no contact takes place any more, not even in the aforementioned different "Printing ON" and "Printing OFF" eccentric-positions of the correspondingly mounted numbering shaft 35. The clamping force of this results from a compression spring 47, which is introduced into a bore 48 formed in the respective lever arms 21 and 22 and presses against a lower stop 49 of the gripper arm 41.

It is possible, fundamentally, for example via a non-illustrated cam member actuated by means of a hand lever, also to release the clamping force occasionally outside of the press during the presetting position of the numbering and imprinting device 2 in order thereby to enable the numbering shaft 35 to be rotated for the purpose of equipping it with numbering units.

Figure 4:
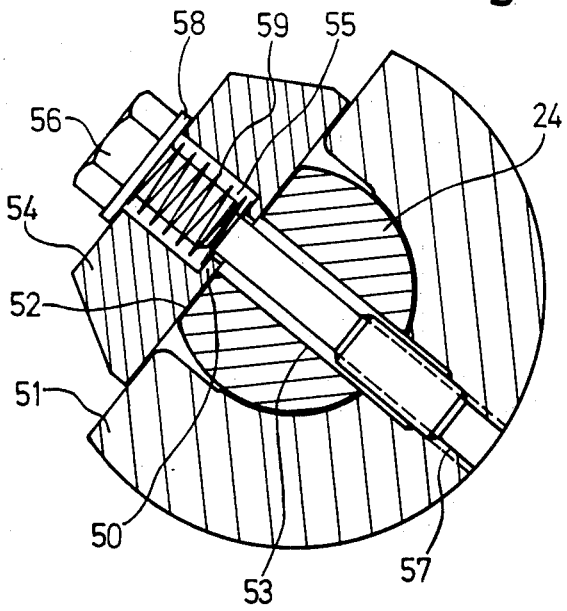
FIG. 4 is an enlarged cross-sectional view of the bearing of the numbering-shaft in a side panel of the machine.

FIG. 4 shows the bearing of the journal pins 24 of the numbering shaft 35 in the printing press 1. To this end, swivellably arranged half-shells 51 are provided at side panels 37 and 38, the journal pins 24 being inserted in the half-shells 51. The journal pins 24 are each formed with a flat 52 and a bore 53 in vicinity of the bearings or mountings therefor. A clamping jaw 54 closes off the half-shell 51 in a manner that a securing bolt or clamping screw 56 is able to be introduced through a bore 55 formed in the clamping jaw 54 and through the corresponding bore 53 formed in the journal pin 24, the securing bolt or clamping screw 56 being screwed into a thread 57 formed in a lower region of the half-shell 51. A bayonet-type closure, for example, is also conceivable as an alternative fastening means in this regard. A washer 58, as well as a compression spring 59 resting against the washer and against a stop 59 of the clamping jaw 54, serve to appropriately brace the securing bolt or clamping screw which, together with the clamping jaw 54, forms a unit.

The half-shell 51 associated with the drive-side side panel 37 of the printing press 1 is connected to an otherwise non-illustrated gear-wheel of the drive chain via a corresponding drive-connecting element 69, the half-shell 51 thereby transferring the drive to the numbering shaft 35.

Figure 5:
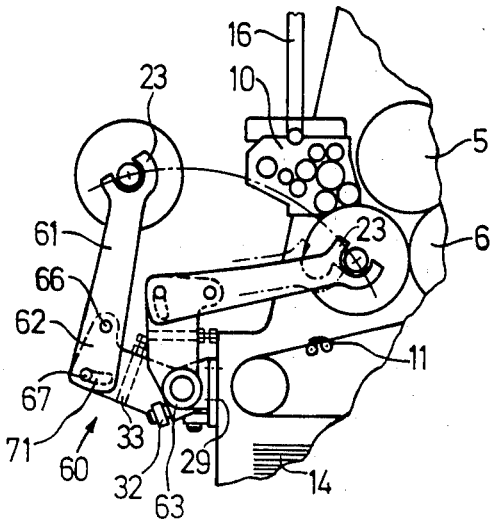
FIG. 5 is a fragmentary view of FIG. 1 showing another embodiment of the swivelling changing device with a bipartite or two-part swivel arm.

FIG. 5 shows a further different embodiment of the swivelling device 60 which is constructed so that, after the numbering or imprinting device 2 has been brought into its working position in the printing press 1 with the aid thereof and has been locked into the half-shell bearing, the swivelling device 60 can once again be swung out of the machine.

To this end, again, pairs of arms or levers are provided i.e. for each journal pin 24 of the numbering shaft 35, the arms or levers being formed of two articulatingly interconnected legs 61 and 62. Each lower leg 62 is connected to a tubular cross-member 63 which is guided in a carriage guide 28 according to the embodiment shown in FIG. 1. Slide guides 64 arranged in the tubular cross-member 63 provide for accurate guidance. The two legs 61 and 62 are rotatably interconnected by a shaft 65 at a respective pivot point 66. Each leg 61 has, in a lower region thereof, a further mounting point 67 for a further shaft 68. Because of a slide guide or connecting link guide 71 in this region of each lower leg 62, both of the respective legs 62 are swivellable a given amount with respect to one another. Because of this arrangement, the fork-shaped openings 23 of the upper leg 61, which may be defined either by a single part or by two parts such as in FIG. 4, can be moved downwards out of the region of the numbering shaft, and the entire swivelling device 60, as indicated, in phantom, can then be swung outwardly.

Figure 6:
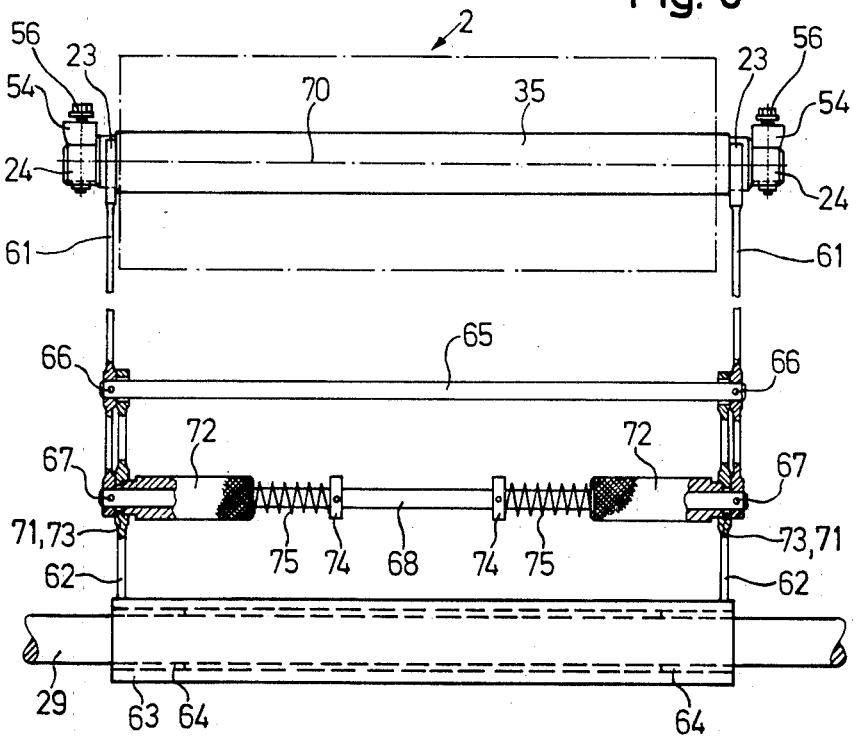
FIG. 6 is a side elevational view of the swivelling device according to FIG. 5.

In the movement phase which is loaded by the inserted numbering and imprinting device 2, both of the legs 61 and 62 are interconnected, fixed against rotation, by indexing sleeves 72 according to FIG. 6. The indexing sleeves 72 are movable longitudinally along the shaft or axle 68, latching or engaging resiliently in indexing bores 73 formed in each lower leg 62. The latching movement is assisted by means of stops 74 secured to the shaft or axle 68, compression springs 75 being braced against the stops 74.

The indexing sleeves 72 are constructed as handles capable of being moved by the press operator with both hands axially along the shaft or axle 68 and are also capable of executing the rotational and swivelling movements of the swivelling device 60.

To change the numbering and imprinting device 2 it is also necessary, to bring the associated inking unit 10 into one of the depositing positions 18 and 19 previously shown in FIG. 1, by means of the swivelling mechanism 15.

Figure 7:
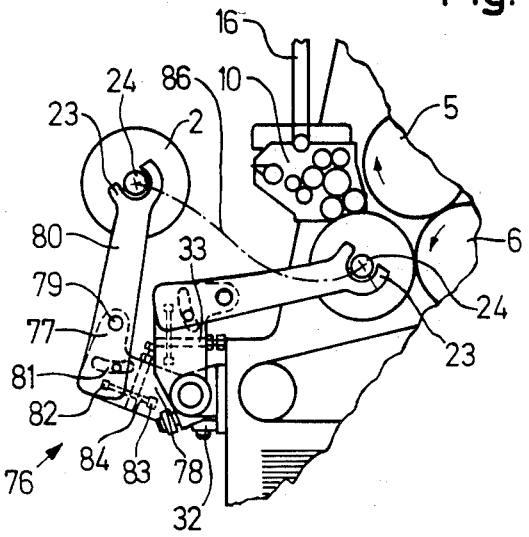
FIG. 7 is another view like that of FIG. 5 of a third embodiment of the swivelling device with a bipartite swivel arm assisted by a gas-pressure spring.

A final different embodiment of the swivelling device 76, which permits the numbering and imprinting device 2 to be changed without swinging the inking unit 10 away, is shown in FIG. 7.

The embodiment of FIG. 7 corresponds essentially to that shown in FIGS. 5 and 6, the only difference being that the forward projection 77 of the lower leg 78 is slightly lengthened so that the pivot point 79 thereof with the upper leg 80, which may be provided with a single part or two parts defining the fork-shaped opening 23, creates more favorable lever-arm relationships for the desired purpose. The coulisse or slide guide 81 is also slightly lengthened so as thereby to increase the swivelling range between the two legs 78 and 80.

In the illustrated embodiment of FIG. 7, a gas pressure or compression spring 84 is arranged at controlling or linkage points 82 and 83 of the legs 78 and 80 and serve to assist the manual swivelling movement carried out by the press operator via the indexing sleeves 72.

It is thereby possible to bring the numbering and imprinting device 2, for example, in accordance with the cam or curve 86 indicated by the dash-dot line in FIG. 7, out of the printing press 1, the inking unit 10 being out of the way.

With the aid of the swivelling mechanism 15, the inking unit 10 only has to be brought into one of the previously indicated depositing positions 18 and 19 if unimpeded access to the printing unit cylinders 5 and 6, for example, of the printing press 1 is required for setting or assembly purposes.

The half-shell mounting or bearing according to FIG. 4 is, for reasons of clarity, not shown in FIGS. 5 and 7. With the fork-shaped openings being provided in accordance with FIG. 3, the arrangement of the opening cam 45 must be adapted to the movement relationships of the swivelling devices 60 and 76 (FIGS. 5 and 7). A further possibility, not further dealt with in the figures, would be, for example, the use of the swivelling device 76 for the numbering and imprinting device 2 also for moving (swivelling) the inking unit 10 associated therewith, so that the inking unit 10, like the numbering and imprinting device 2, may thereby be brought out of printing press 1 and deposited, during the performance of the foregoing setting or assembly operations, on a swivelling device 76 which is displaced laterally via the carriage guide 28. It is thereby possible then to dispense with the swivelling mechanism 15.

The foregoing is a description corresponding in substance to German Application No. P 34 07 681.6, dated Mar. 2, 1984, the International priority of which is being claimed for the instant application, and which is hereby made part of this application. Any material discrepancies between the foregoing specification and the aforementioned corresponding German application are to be resolved in favor or the latter.

I claim:

1. Device for exchanging a numbering and imprinting device having a numbering shaft for carrying numbering units thereon and provided with an associated inking unit in a printing press, for another numbering and imprinting device mounted on another numbering shaft, the exchanging device comprising a swivelling device swivellable about a horizontal pivot axis extending parallel to the axis of the numbering shaft, said swivelling device being formed of gripper elements, arranged on a cross member and carrying respective left-hand and right-hand journal pins of the numbering shaft, said horizontal pivot axis being formed by the axis of said cross-member, and said cross-member being mounted longitudinally displaceably on a carriage guide secured to a machine frame located at an end of the printing press, said carriage guide extending parallel to the axis of the numbering shaft.

2. Device for exchanging a numbering and imprinting device having a numbering shaft for carrying numbering units thereon and provided with an associated inking unit in a printing press, for another numbering and imprinting device mounted on another numbering shaft, the exchanging device comprising swivelling means swivellable about a horizontal pivot axis, extending parallel to the axis of the numbering shaft, said swivelling means being formed of gripper elements arranged on a cross member and carrying respective left-hand and right-hand journal pins of the numbering shaft, said horizontal pivot axis being formed by the axis of said cross member, and said cross member being mounted longitudinally displaceably on a carriage guide secured to a machine frame located at an end of the printing press, said carriage guide extending parallel to the axis of the numbering shaft, said swivelling means comprising respective swivelling devices associated with each of the numbering and imprinting devices, said carriage guide having a length sufficient for accommodating three of said swivelling devices simultaneously adjacent one another.

3. Device according to claim 1 including a swivelling mechanism operatively connected with the inking unit associates with the first-mentioned numbering and imprinting device, said swivelling mechanism comprising articulatingly interconnected swivel arms respectively mounted rotatably in an upper region of side panels of the printing press, the inking unit being transportable by said swivel arms selectively into two depositing positions, respectively.

4. Device according to claim 1 wherein said swivelling device is carried by said carriage guide, and said machine frame located at the end of the printing press to which said carriage guide is secured is located adjacent a sheet delivery of the printing press.

5. Device according to claim 1, wherein said cross member is of tubular construction and said carriage guide is correspondingly shaft-like for carrying said cross-member and is mounted at the ends thereof on bearing supports of a base plate secured to said machine frame.

6. Device according to claim 5 including stops located on said swivelling device, said stops being abuttable against said base plate and said machine frame, respectively, for limiting the swivelling range of said swivelling device.

7. Device according to claim 1 including half-shells connected, respectively, freely rotatably and fixedly attached to the drive of the printing press, said half-shells serving as bearings for said journal pins of the numbering shaft in side panels of the printing press, said half-shells cooperatively connected with clamping jaws as well as with clamping screws engaging in said half-shells for holding said journal pins of the numbering shaft.

8. Device according to claim 1 wherein said gripper elements of said swivelling device are formed as L-shaped angular lever arms having handles thereon, each of said lever arm being formed in a forward region thereof with a respective opening defined by a fork-shaped structure for receiving therein said journal pins at both ends of the numbering shaft, said lever arms being secured through the intermediary of a strut as well as through the intermediary of another arm to said cross member.

9. Device according to claim 1 wherein each of said gripper elements of said swivelling device is formed of two legs articulatingly connected to one another, said legs being rotatably connected by a shaft at a common pivot point, one of said legs being formed with an opening defined by a fork-shaped structure for receiving therein said journal pins, respectively, at both ends of the numbering shaft and having a further bearing point for another shaft, and the other of said legs having a connecting link guide operatively associated with said other shaft.

10. Device according to claim 9 including indexing sleeves disposed on said other shaft, said indexing sleeves being displaceable in longitudinal direction along said other shaft, and further including stops and compression springs on said other shaft for bracing said indexing sleeves, one of said legs being formed with index bores wherein said indexing sleeves are latchable in an end position of the swivelling movement of both of said legs.

11. Device according to claim 10 wherein said indexing sleeves are formed as handles.

12. Device according to claim 9 including a spring element engaging the pivot points of said legs of said swivelling device, and a connecting link guide having suitable dimensions for varying the relative swivel angle between both of said legs over a wide range.

13. Device according to claim 9, wherein said numbering and imprinting device and the inking unit operatively associated therewith are movable by said swivelling device.

14. Device according to claim 8 wherein said forward region of said gripper elements with said fork-shaped structure defining said opening has a two-part construction, and including a gripper arm rotatably mounted in a pivot point of each of said gripper elements and braced against a compression spring, and a roller lever connected to said pivot point and fixed against rotation with respect to said gripper arm, said roller lever carrying a cam roller following an opening cam disposed on said machine frame in vicinity of a bearing for said numbering shaft.

15. Device according to claim 9 wherein said forward region of said gripper elements with said fork-shaped structure defining said opening has a two-part construction, and including a gripper arm rotatably mounted in a pivot point of each of said gripper elements and braced against a compression spring, and a roller lever connected to said pivot point and fixed against rotation with respect to said gripper arm, said roller lever carrying a cam roller following an opening cam disposed on said machine frame in vicinity of a bearing for said numbering shaft.

16. Device according to claim 8 wherein said fork-shaped structure defining said opening in said forward region of said gripper elements is of one-part construction.

17. Device according to claim 9 wherein said fork-shaped structure defining said opening in said forward region of said gripper elements is of one-part construction.

18. Device according to claim 14 wherein said opening defined by said fork-shaped structure having a two-part construction is of such dimension that, in both "Printing ON" and "Printing OFF" positions of the rotary numbering shaft, the numbering shaft is out of contact with said fork-shaped structure.

* * * * *